United States Patent [19]

Pope

[11] Patent Number: 4,471,724

[45] Date of Patent: Sep. 18, 1984

[54] LIQUID HEATING SYSTEM

[76] Inventor: William T. Pope, Rte. 2, Box 37, Creekview Dr., Lucama, N.C. 27851

[21] Appl. No.: 342,730

[22] Filed: Jan. 26, 1982

[51] Int. Cl.[3] ..... F22B 5/00

[52] U.S. Cl. ..... 122/13 R; 126/163 R; 126/121; 122/15; 122/498; 110/234; 110/267; 110/180

[58] Field of Search ..... 122/2, 22, 15, 13 R, 122/214, 498; 110/116–118, 162, 180, 298–300, 267; 126/163 R, 163 A

[56] References Cited

U.S. PATENT DOCUMENTS

| | | | |
|---|---|---|---|
| 452,831 | 5/1891 | Brown | 110/234 |
| 1,974,143 | 9/1934 | Spencer | 110/267 |
| 3,155,080 | 11/1964 | Braun | 110/180 |
| 3,705,717 | 12/1972 | Hadberg | 110/180 |
| 4,201,186 | 5/1980 | Paquin | 110/267 |
| 4,204,832 | 5/1980 | Miller | 110/162 |
| 4,287,870 | 9/1981 | Johnson | 126/163 R |
| 4,321,879 | 3/1982 | Toivo | 126/121 |
| 4,326,496 | 4/1982 | Bentrem | 126/163 R |
| 4,360,000 | 11/1982 | Down | 126/163 R |
| 4,360,152 | 11/1982 | Schlatter et al. | 122/15 |

*Primary Examiner*—Henry C. Yuen
*Attorney, Agent, or Firm*—Mills & Coats

[57] ABSTRACT

This invention is a non-fossil fuel fired hot water system which allows a large amount of water or other liquid to be raised to a relatively high temperature, but below the boiling point, in a relatively short period of time. Due to a unique air circulation system, extremely high temperatures of the combustible material can be obtained with secondary burning eliminating all visible particulate material from the exhaust stack of the system. The unique firebox itself is disposed such that it is surrounded by water on all sides including the access closures for said firebox.

7 Claims, 5 Drawing Figures

LIQUID HEATING SYSTEM

FIELD OF INVENTION

This invention relates to heating systems and more particularly to solid non-fossil, organic material fired heating systems.

BACKGROUND OF INVENTION

Since heating of closed spaces began, mankind has been concerned with obtaining as much heat from a given amount of fuel as possible. During the period of plentiful oil and gas supplies not only the heating of enclosures such as buildings and homes but also the use of heat in the curing of crops and the like was accomplished through the use of these fossil fuels. As the cost of fuels has escalated, however, alternative sources of energy have been explored.

In large commercial operations, however, such as the critically controlled temperatures for curing tobacco, drying grain and the like, wood-fired and solar systems have not been thought practical on a large scale because of the inefficiency of such system as well as, in the case of the wood and organic material fired units, the pollution created as a by-product of the combustion process.

BRIEF DESCRIPTION OF INVENTION

After much research and study into the above-mentioned problems, the present invention has been developed to provide a means for supplying a controllable output heat source with maximum utilization of the fuel with such complete combustion being accomplished that no undesirable by-products of combustion are expelled into the ambient atmosphere.

The above is accomplished through a unique draft system which creates an extremely hot fire but which does not completely consume the draft oxygen so that the remaining can be used in an after burn of the remaining combustibles coming off the main combustion core. This, combined with the fact that the firebox itself is completely surrounded by the fluid being heated, prevents warping and other problems normally associated with high temperatures as well as giving greater recovery of heat from the combustion processes.

The system of the present invention can be used, among other things, to heat buildings of large square footage areas as well as for such diverse usages as the curing of multiple tobacco barns from a single heating unit.

In view of the above, it is an object of the present invention to provide a heating system which utilizes a high percentage of the products of combustion with superior heat recovery.

Another object of the present invention is to provide a heating system which can rapidly raise the temperature of a fluid while at the same time discharging no visible pollutants into the ambient atmosphere.

Another object of the present invention is to provide a unique heating system which uses a forced draft to reach high temperatures of the primary combustible material while at the same time allowing such forced draft air to also support secondary combustion in an after-burner effect to eliminate the remaining combustible particles from the exhaust system.

Another object of the present invention is to use an improved firebox disposed completely within a large tank-like container of fluid to rapidly and efficiently heat such fluid.

Another object of the present invention is to provide water doors for use in conjunction with a fluid heating system to obtain even greater efficiency from the system.

Other objects and advantages of the present invention will become apparent and obvious from a study of the following description and the accompanying drawings which are merely illustrative of such invention.

DETAILED DESCRIPTION OF INVENTION

Figure 1:
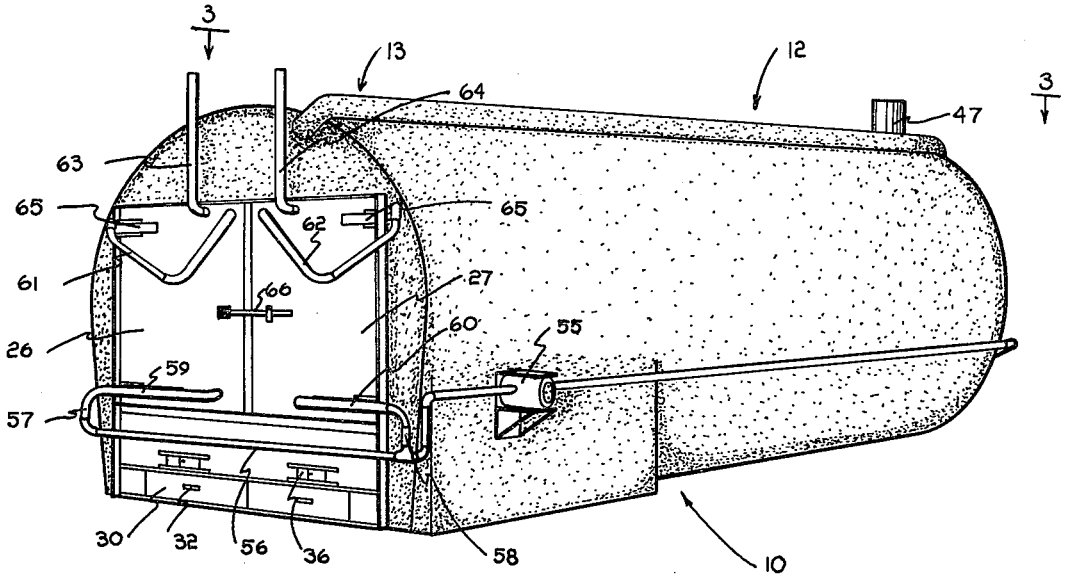
FIG. 1 is a perspective view of the liquid heating system of the present invention.

With further reference to the drawings, the liquid heating system of the present invention, indicated generally at 10, includes an elongated water type tank 11 formed from steel or other suitable material. This tank includes a generally cylindrical shaped main reservoir portion 12 and a somewhat rectangular shaped firebox portion 13.

A base 14 formed from concrete or other suitable material is provided for the liquid heating system 10.

The firebox 15 itself within the firebox portion 13 is generally square in configuration and is defined by a rear wall 16, a roof or ceiling wall 17, and side walls 18 and 19. Each of these walls defined have water or other liquid to be heated surrounding the exterior thereof. These firebox walls are preferably formed from high grade steel and, of course, are joined by water tight weldment or the like.

Figure 2:
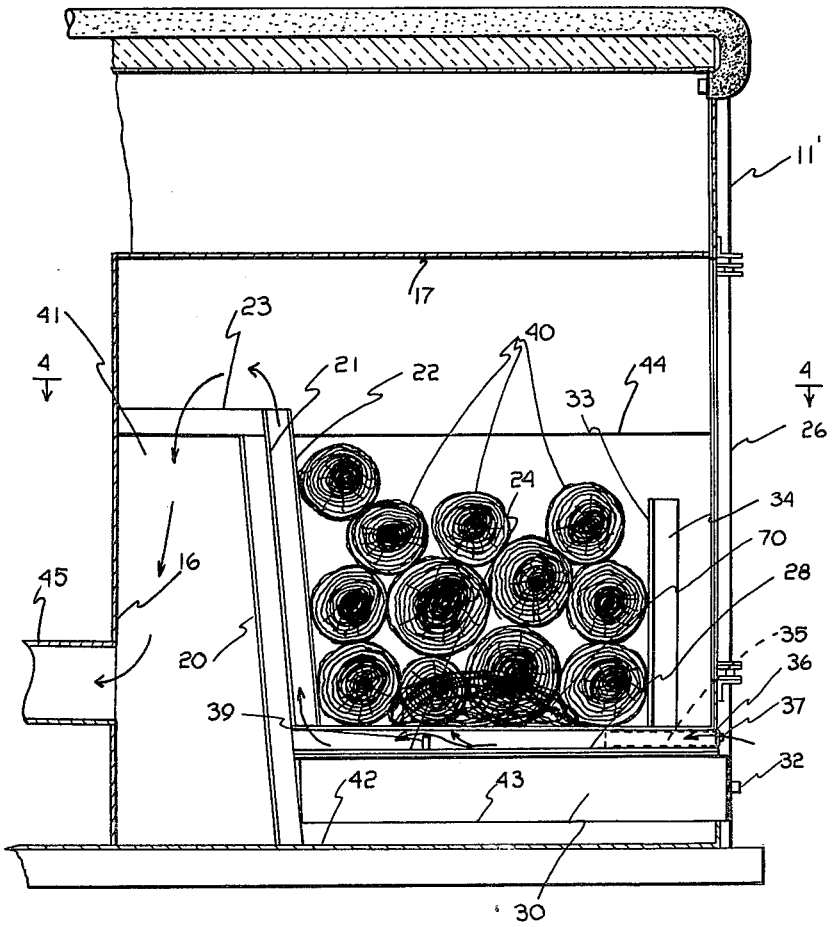
FIG. 2 is an enlarged sectional view of the firebox portion of the present invention.
Figure 3:
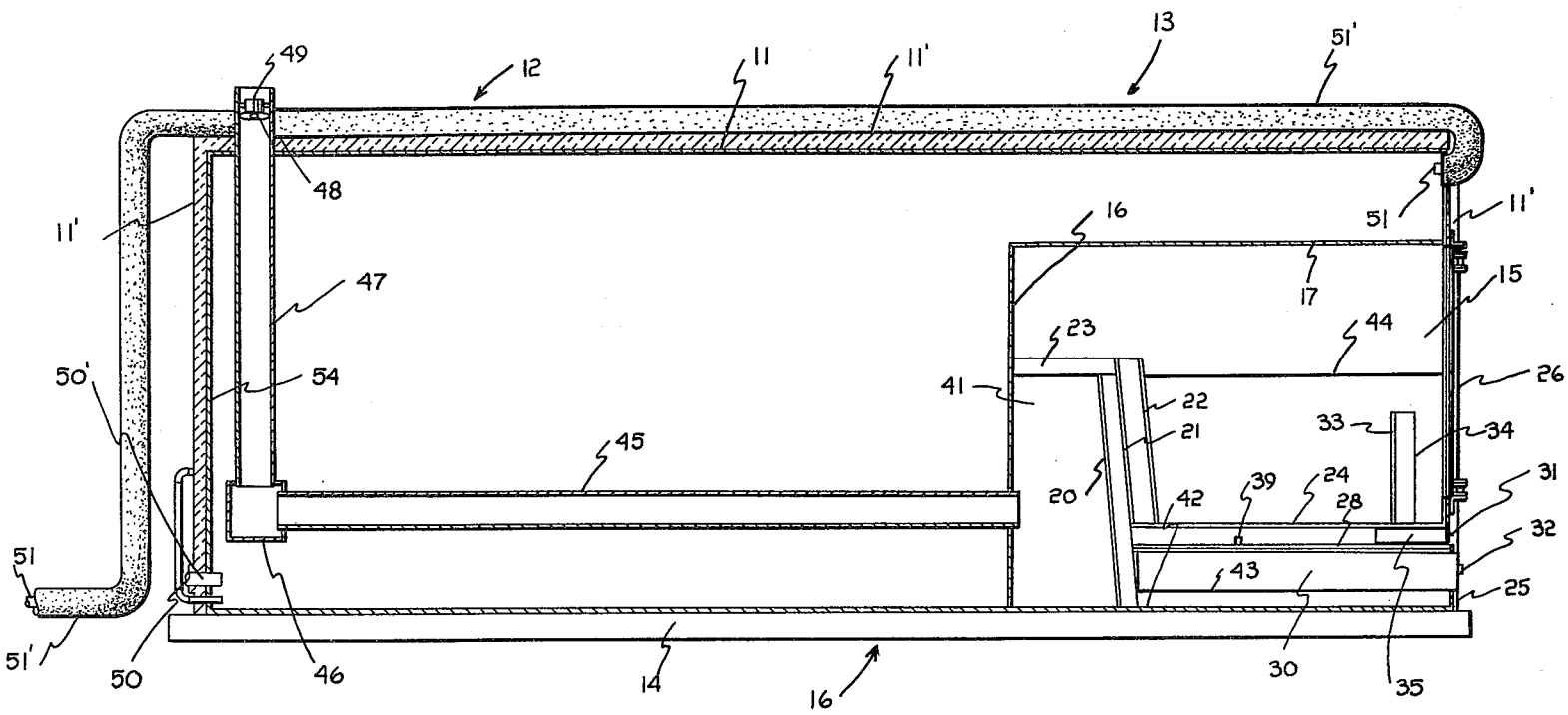
FIG. 3 is a section view taken through lines 3—3 of FIG. 1.
Figure 4:
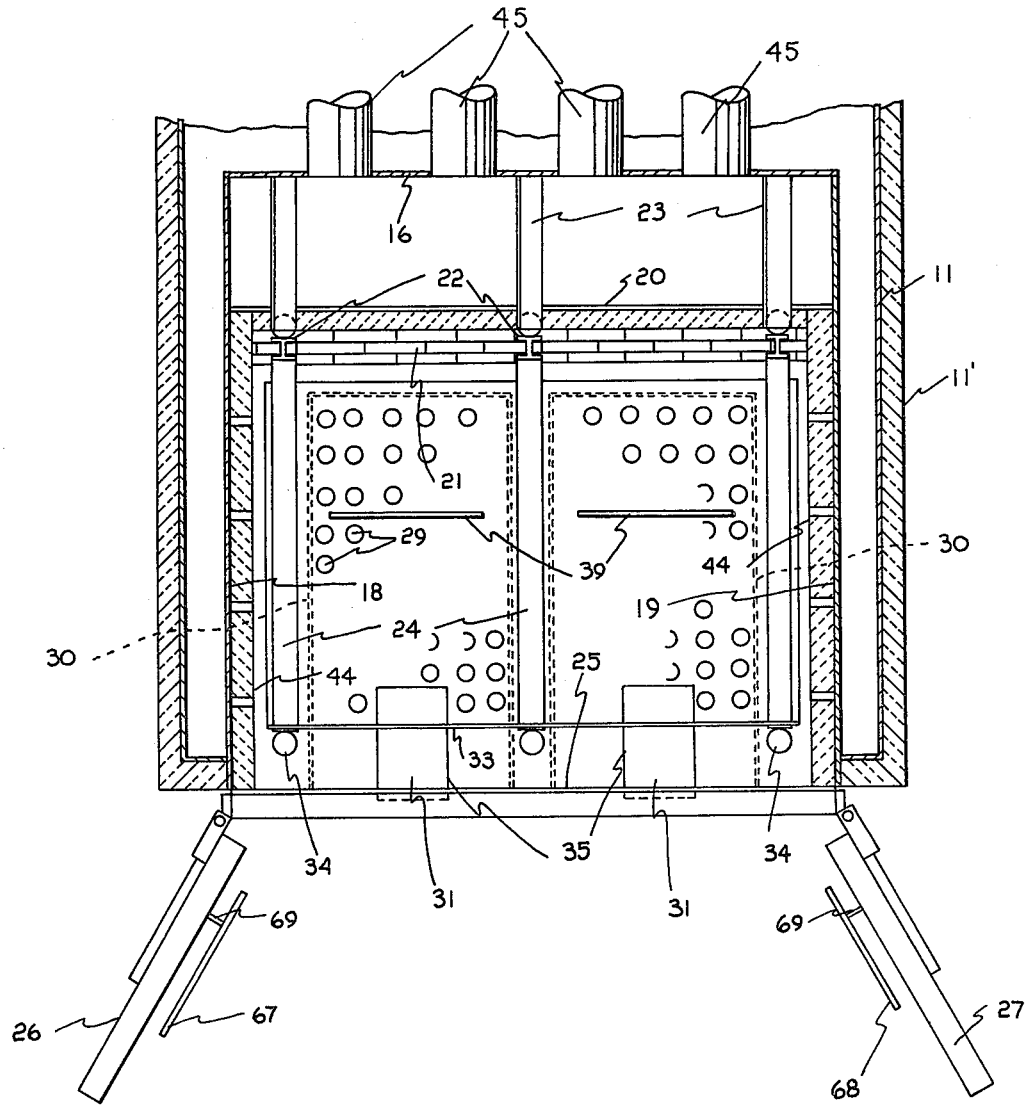
FIG. 4 is a sectional view taken through lines 4—4 of FIG. 2.
Figure 5:
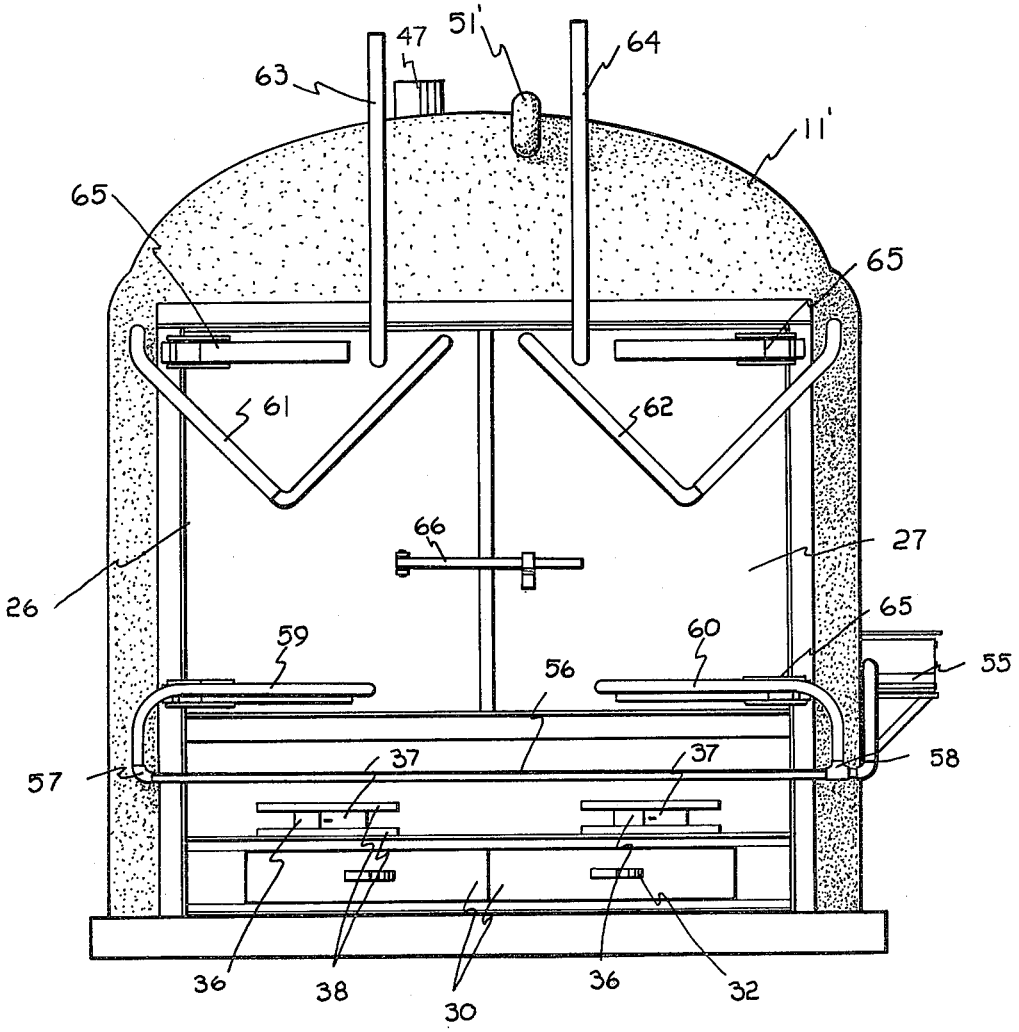
FIG. 5 is a front elevational view of said system.

Within the firebox above described is a rearwardly tilted knee wall 20 extending between the lower portions of side walls 18 and 19 as can clearly be seen in FIGS. 2 through 4. This knee wall can be formed from sheet steel and secured by weldment or otherwise to said side walls. Fire brick 21 is provided on the interior side of knee wall 20. A plurality of generally vertically disposed fuel spacer rails 22 are provided which extend upwardly adjacent the face of fire brick 21.

A plurality of braces 23 are provided between vertical rails 22 and the interior side of rear wall 16. These braces serve not only to hold knee wall 16 in a more secure position but also act as a catalyst to the after-burning process as will hereinafter be described in greater detail.

Approximately two-thirds of the way down knee wall 20 from braces 23 are horizontally disposed fuel spacer rails 24. These rails extend from knee wall 20 to the upper portion of front wall 25 of firebox 15 which is just below the bottom portion of water doors 26 and 27.

Immediately below the horizontal rails 24 is a grate 28. This grate is preferably formed from sheet steel and includes a plurality of generally round openings 29 therein. Openings of two to three inches in diameter have been found to be optimum size. This specific arrangement for the grate allows hot coals to fall between the horizontal fuel support rails 24 as the burning process takes place and to reflect heat back against such logs and yet when such coals are burned to ash the same will fall through the openings 29 into the ash pans 30 described below.

One further advantage of having the grate 28 formed from sheet steel with openings 29 therein as described is that an elongated fire tool (not shown) of any convenient configuration can be inserted through damper openings 31 to knock the accumulated ashes from the grate plate 28 through openings 29. This cleaning of the grate 28, since it is accomplished through the damper openings 31, can be executed at any time regardless of whether the firebox is loaded or unloaded and regardless of whether the fire is burning at maximum capacity or at some lesser amount.

As mentioned above, ash pans 30 are provided immediately below grates 28 and are so constructed that they pass through the lower portion of front wall 25 and can be slidingly inserted and removed therethrough. These ash pans are of simple four-sided and bottom construction with handles 32 on the exterior thereof for easy removal.

Although due to air control, these ash pans would not normally be removed for cleaning during full fire operation, they can be so removed, quickly emptied and reinserted if the situation dictates such action.

Adjacent the front portion of firebox 15 is a generally vertically disposed combination heat shield and front fuel support 33. This heat shield and fuel support is held in generally upright position by bracket members 34.

The damper openings 31 referred to above include a rectangular sleeve 35 which communicates between the area immediately above the grate 28 interior of heat shield 33 and the ambient air. To control the amount of air passing through the damper openings 31 of damper sleeves 35, damper controls 36 are provided. These are preferably of the flat plate type with a grip 37 provided in the center thereof and are supported by slide tracks 38. Since damper control slide plates and slide tracks are known to those skilled in the art, further detailed description of this portion of the present invention is not deemed necessary.

A draft flow deflector baffle 39 formed from angle iron or other suitable material is disposed on the upper surface of grate 28 and extends part way to the top of horizontal fuel support rails 24 as can clearly be seen in FIGS. 2 and 3. The purpose of this deflector is to force part of the draft air coming through damper opening 31 into the hottest portion or central core of the fire caused by the burning of the combustible fuel 40. Since deflector baffle 39 is lower than the overall height of horizontal fuel rails 24, combined with the rate of air flow created as will hereinafter be described in greater detail, not all of the air entering damper opening 31 is deflected into the core of the burning fuel but a portion of such air continues to flow below the fuel but above the grate and between the log rails to knee wall 20 and then up the same between vertical rails 22 and, following an after burn, over into the secondary area 41. This process of burning and secondary combustion or after burn will hereinafter be set forth in greater detail.

As set forth above, fire brick 21 is used on the interior of knee wall 20. This brick is also used in firebox 15 above the bottom wall 42 as indicated at 43. Further the interior of side walls 18 and 19 are lined with fire brick 44 at least as high as knee wall 20.

Communicating with and leading from the secondary area 41 are a plurality of exhaust tubes 45. Each of these tubes passes through the liquid contained within the main reservoir portion 12 of the heating system 10 of the present invention.

The end of the exhaust tubes 45 opposite area 41 communicates with manifold 46 which in turn communicates with exhaust stack 47. This exhaust stack 47 as well as manifold 46 are surrounded by the liquid within reservoir portion 12. The stack 47 passes vertically through such liquid and exits into the ambient atmosphere above the tank 11.

In the upper portion of exhaust stack 47 is operatively disposed a draft fan 48 driven by motor 49. This draft fan is preferably of the multi-speed type so that when operated in conjunction with the damper controls 36, accurate control of the burning within firebox 15 can be accomplished. Because of the arrangement of the system of the present invention, exhausting gases passing from stack 47 are of such a cooled temperature that extraordinary heat protection for the fan equipment has not been found necessary.

Another unusual feature of the system of the present invention is that the liquid outlet 50 going to the house, building, tobacco barn, greenhouse or other structure to be heated (not shown) is at the bottom of tank 11 farthest from firebox 15.

On the other hand, return line 51 from the house, building, tobacco barn, greenhouse or other structure (not shown) passes along the upper portion of the tank 11 to be preheated and then enters such tank immediately above firebox 15 as can clearly be seen in the Figures.

The purpose of this unusual inlet and return line arrangement is to maintain below boiling temperature adjacent the firebox and to create circulation currents from the firebox area to the furthest point away therefrom within tank 11.

A second liquid outlet line 53 passes through the rear wall 54 of tank 11, passes up around and outside of said tank, through circulating pump 55 and into water door manifold 56. This manifold has two outlet portions 57 and 58 which are connected to flexible lines 59 and 60 which in turn communicate to the interior of hollow liquid or water filled doors 26 and 27, respectively.

Flexible door outlet lines 61 and 62 are also connected, respectively, to doors 26 and 27 and communicate from the interior thereof to the interior of tank 11 in the area where the corner of the firebox 15 comes closes to the interior of such tank. The reason for this particular arrangement is so that the coolest water within the tank (which even then is of high enough temperature for heating of the structures enumerated above) can be circulated by pump 55 through the liquid filled doors 26 and 27 of firebox 15 to cool the same and to heat such liquid at the same time. This liquid is also being exhausted through outlet lines 61 and 62 as live water into the narrowest area between the firebox 15 and the interior of the tank 11 to prevent boiling due to overheating in such area.

The system of the present invention is nonpressurized and thus cannot be considered a boiler. Since the liquid filled doors have a large amount of surface area exposed of the interior of firebox 11 relative to the amount of liquid contained therein, some steaming may occur. To prevent pressure build-up, ambient air vents 63 and 64 are provided in doors 26 and 27, respectively, to maintain ambient pressure within such doors. Since these air vents extend above the top of tank 11, no liquid within the system will be lost other than in vapor form.

Although not specifically shown and not deemed necessary for the system as described, a third ambient air vent could be provided communicating between the interior of tank 11 and the ambient atmosphere above such tank if boiler codes so require to eliminate their application.

The water doors 26 and 27 include heat shields 67 and 68 mounted on stand-offs 69 and are closingly mounted on hinges 65 in the normal manner of operation of such devices. Also a pivoted bar lock 66 is provided for releasably holding the doors 26 and 27 in the closed position during firing of the liquid heating system of the present invention.

By way of example, using a 13,000 to 14,000 tank, the deflector baffles 39 would be approximately two inches high with the fuel support rails 22 and 24 being approximately 5 inches high. The heat shield 33 is disposed approximately twelve inches interiorly from the doors 26 and 27 with the distance between such heat shield and fire brick 21 being in the neighborhood of forty-two inches. The knee wall 26 is disposed at an angle of approximately 20 degrees with the area therebehind between such knee wall and adjacent rear wall 16 of firebox 15 being approximately twenty-four inches. The exhaust flues or tubes 45 have been found to best be disposed approximately thirty-six inches below the top of the wall 20.

Ambient atmospheric air is approximately seventy-eight percent nitrogen, twenty-one percent oxygen with one percent other gases. Nitrogen is, of course, inert and oxygen is necessary to sustain combustion.

Keeping the above in mind, the air velocity regulated by fan 48 and damper controls 36 is such that only part of the oxygen diffuses through the nitrogen to ignite and sustain the fire core 70 at between 1800 and 2000 degrees Fahrenheit. The remaining or unconsumed oxygen (which ideally is approximately twenty percent of the draft air) is super heated as it passes under the fire core and up the wall 20 to between 1600 and 1800 degrees Fahrenheit. When this super-heated oxygen combines with the products of combustion from the fire core 70, in combination with the catalytic effect of metal braces 23, an after-burn of such products of combustion occurs approximately two feet above wall 20.

Thus it can be seen that part of the oxygen in the draft air is used to support combustion within the fire core 70 and the remaining oxygen is prevented from being consumed by the velocity of the draft until it reaches the top of the wall 20 and the area adjacent braces 23 where such remaining oxygen supports after burn combustion. The clean exhaust fumes are then sucked by fan 48 through the flue system and are returned to the ambient atmosphere from stack 47.

Actual tests have shown that only three hundred pounds of ash have been left from the burning of one hundred fifty thousand pounds of wood. The heating system as hereinabove described has been used to operate nine bulk tobacco curing barns simultaneously with the total wood consumption per barn being three-quarters of a cord during the entire curing process.

In essence the burning process of the present invention is a diffusion-control chemical reaction which effectively consumes 0.998 percent of the fuel placed therein.

To prevent heat loss, the entire tank area 11 is insulated with a foam type insulation as indicated at 11'. Likewise, inlet and return lines 50 and 51 are insulated as indicated at 50' and 51'. Since the liquid being pumped through doors 26 and 27 is desired to be as cool as possible, the line 53 leading from the rear 54 of tank 11, through pump 55, and into said doors are preferably not insulated.

From the above it can be seen that the liquid heating system of the present invention provides a highly efficient, economical means of heating large area structure or multiple structures at a minimum cost. With the firebox being loaded through the firebox doors with a forklift, an easily stoked system is also provided. These features are combined with the fact that ashes can be removed to the ash pans even during full operation of the burning process. The ash clean-out is likewise easy to accomplished with very little time and effort being required.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. In a liquid heating system including a liquid reservoir means at least partially surrounding a firebox portion and including an opening for fueling the firebox, the improvement comprising: means within said firebox for supporting fuel in spaced relationship from the lower portion of such firebox; knee wall means within said firebox extending upwardly to a point generally above the fuel resting on said support means; second means for supporting said fuel in spaced relationship from said knee wall; an open area forming a flue chamber above and on the side of said knee wall opposite said fuel and communicating with said open area below the upper portion of said knee wall for removing the products of combustion from the interior of the firebox to ambient atmosphere whereby draft air which is not consumed within a fire core created in said supported fuel will be superheated as it moves up said knee wall to after-burn unconsumed products of combustion.

2. The liquid heating system of claim 1 wherein a draft air deflecting baffle means is provided above said support means but below said fuel supporting rail means whereby additional draft air can be directed into said fire core created within said fuel.

3. The liquid heating system of claim 1 wherein a means for forcing draft air to enter said damper means is provided.

4. The liquid heating system of claim 3 wherein said draft means is a fan means located in said flue.

5. The liquid heating system of claim 4 wherein said draft fan is located in the ambient air end of said flue.

6. The liquid heating system of claim 5 wherein a closure of said fuel opening is provided and includes passageways for circulation of liquid therethrough whereby cooling of said closure means and the heating of said liquid can be accomplished.

7. The liquid heating system of claim 6 wherein a heat shield means is provided between said fire core and said closure.

* * * * *